US009500455B2

(12) United States Patent
Riess

(10) Patent No.: US 9,500,455 B2
(45) Date of Patent: Nov. 22, 2016

(54) PROJECTILE HAVING A SOLDERED PROJECT CORE

(71) Applicant: RUAG AMMOTEC GMBH, Fuerth (DE)

(72) Inventor: Heinz Riess, Fürth (DE)

(73) Assignee: RUAG AMMOTEC GMBH, Fuerth (DE)

( * ) Notice: Subject to any disclaimer, the term of this patent is extended or adjusted under 35 U.S.C. 154(b) by 0 days.

(21) Appl. No.: 14/442,877

(22) PCT Filed: Nov. 15, 2013

(86) PCT No.: PCT/EP2013/073920
§ 371 (c)(1),
(2) Date: May 14, 2015

(87) PCT Pub. No.: WO2014/076228
PCT Pub. Date: May 22, 2014

(65) Prior Publication Data

US 2015/0292845 A1 Oct. 15, 2015

(30) Foreign Application Priority Data

Nov. 15, 2012 (DE) ..... 10 2012 022 357

(51) Int. Cl.
*F42B 12/34* (2006.01)
*F42B 12/74* (2006.01)
*F42B 12/78* (2006.01)

(52) U.S. Cl.
CPC ..... *F42B 12/34* (2013.01); *F42B 12/74* (2013.01); *F42B 12/78* (2013.01)

(58) Field of Classification Search
CPC ..... F42B 12/34; F42B 12/22; F42B 12/367
USPC ..... 102/506, 507, 508, 510, 517
See application file for complete search history.

(56) References Cited

U.S. PATENT DOCUMENTS 3,756,158 A * 9/1973 Anderson ..... F42B 12/78 102/507
3,945,321 A * 3/1976 Mayer ..... F42B 12/32 102/496
4,878,434 A * 11/1989 Sommet ..... F42B 12/78 102/514

(Continued)

FOREIGN PATENT DOCUMENTS

DE 102005039545 A1 7/2006
WO 9720185 A1 6/1997

(Continued)

OTHER PUBLICATIONS

International Search Report for International Application No. PCT/EP2013/073920 dated Jan. 1, 2014.

(Continued)

*Primary Examiner* — Reginald Tillman, Jr.
(74) *Attorney, Agent, or Firm* — Fitch, Even, Tabin & Flannery, LLP

(57) ABSTRACT

The invention relates to a projectile having a projectile base (1), an adjoining cylindrical rear region (2), and a front region (3), which is implemented as an ogive, and the projectile having one or two projectile cores (4, 5) and a projectile jacket (6).
In order that when the projectile strikes a game carcass, the projectile core and the projectile jacket begin to deform simultaneously up to twice or three times the projectile diameter, it is proposed that the projectile core (4) be soldered in the cylindrical rear region (2) to the projectile jacket (6) over its entire axial length.

14 Claims, 3 Drawing Sheets

(56) References Cited

U.S. PATENT DOCUMENTS

Figure 1:
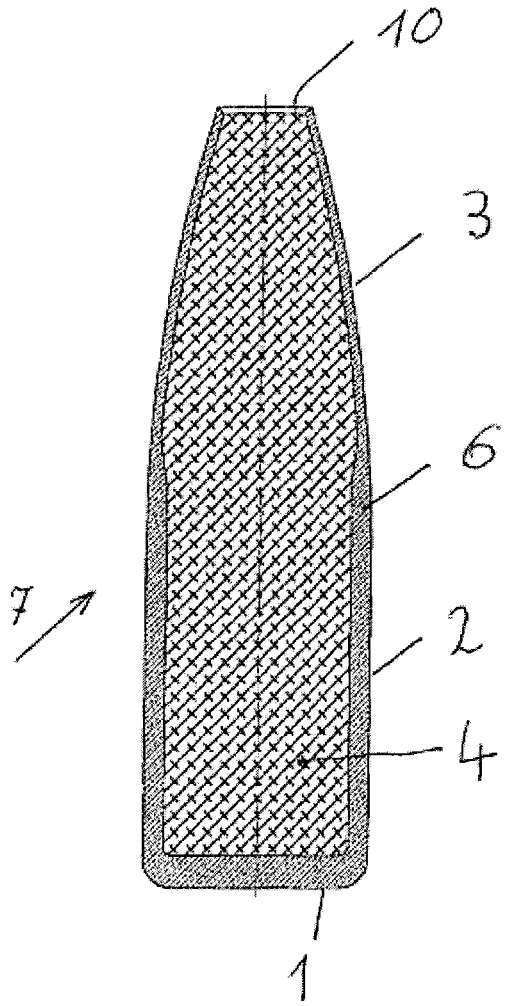

| | | | | |
|---|---|---|---|---|
| 5,078,054 | A * | 1/1992 | Ashok | F42B 12/74 102/506 |
| 6,659,013 | B1 * | 12/2003 | Kellner | F42B 12/06 102/364 |
| 7,543,535 | B2 * | 6/2009 | Herrlinger | F42B 12/78 102/514 |
| 9,046,333 | B2 * | 6/2015 | Masinelli | F42B 12/34 |
| 2015/0107481 | A1 * | 4/2015 | Nygaard | F42B 12/74 102/514 |

FOREIGN PATENT DOCUMENTS

| | | | |
|---|---|---|---|
| WO | 2004053423 | A1 | 6/2004 |
| WO | 2009111654 | A1 | 9/2009 |
| WO | 2012055381 | A2 | 5/2012 |

OTHER PUBLICATIONS

International Preliminary Report on Patentability of Appln. No. PCT/EP2013/073920 dated May 28, 2015 in English.

* cited by examiner

PROJECTILE HAVING A SOLDERED PROJECT CORE

The invention relates to a projectile having a projectile base, an adjoining cylindrical rear region, and a front region, which is implemented as an ogive, and the projectile having one or two projectile cores and a projectile jacket.

The invention is based on the object of refining such a projectile such that when the projectile strikes a game carcass, the projectile core and the projectile jacket begin to deform simultaneously up to twice or three times the projectile diameter.

This object is achieved according to the invention, by a projectile according to claim 1.

Because the projectile core is soldered in the cylindrical rear region to the projectile jacket over its entire axial length, when the projectile strikes a game carcass, the projectile core and the projectile jacket begin to deform simultaneously up to twice or three times the projectile diameter. The projectile mass remains up to 100% stable in this case, since no fragmenting occurs due to the soldering.

In one preferred embodiment, the projectile core in the rear cylindrical region also fills up the front region and is also soldered to the projectile jacket over its entire axial length in the front region. This projectile is then to be used as a deformation projectile.

In an alternative embodiment, a fragmenting second projectile core is arranged in the front region of the projectile, which is compressed with the projectile jacket and not soldered thereon. This projectile is then to be used as a partially fragmenting projectile. This projectile therefore consists of a projectile jacket and two projectile cores, wherein exclusively the projectile core in the cylindrical rear region, which adjoins the projectile base, is soldered to the projectile jacket. In the front region, which is implemented as an ogive, the second projectile core is arranged, which is compressed with the projectile jacket and not soldered thereon.

When this partially fragmenting projectile strikes a game carcass, the partial fragmenting of the projectile begins. The front compressed and non-soldered second core in the projectile jacket begins to fragment with the projectile jacket up to the soldered core and delivers a part of its energy via the resulting splinters. This soldered projectile core continues to form a fixed connection to the projectile jacket and thus forms a defined residual body for the exit from the game carcass. The energy delivery into the game carcass is controlled by the weight ratio between the soldered and compressed core at equal projectile weight.

EXAMPLES

70% fragmenting mass of the second projectile core means a high shock effect and a low depth effect in the game carcass.

30% fragmenting mass of the second projectile core means a low shock effect and a high depth effect in the game carcass.

Internal and/or external intended breakpoints are preferably arranged in the projectile jacket. In the case of the deformation projectile, more rapid deformation is initiated when the projectile strikes the game carcass in this manner. In the case of the partially fragmenting projectile, more rapid partial fragmentation is initiated when the projectile strikes the game carcass in this manner.

In one embodiment, the intended breakpoints are axially extending scores or notches, whereby the axial deformation or axial partial fragmentation is improved.

In another embodiment, intended breakpoints extending in the axial direction are arranged in the soldered core. These intended breakpoints are preferably introduced after the soldering, starting from the tip, for example, using a stamp. These intended breakpoints, which extend in the axial direction, can have different geometries. The deformations may be controlled using these intended breakpoints. The intended breakpoints can have a wedge-shaped cross-section, for example. The stamp to be used would be implemented as wedge-shaped in cross-section therein.

The projectile jacket consists of materials which can be soldered, preferably copper or steel and its alloys.

The soldered projectile core consists of lead-free materials which can be soldered and deformed, preferably tin and its alloys.

The fragmenting second projectile core consists of lead-free materials which can be deformed/fragmented, preferably tin and its alloys.

The fragmenting second projectile core can consist of compressed granules or of materials having incorporated intended breakpoints, preferably tin or its alloys.

The invention will be explained in greater detail hereafter on the basis of three figures.

Figure 3:
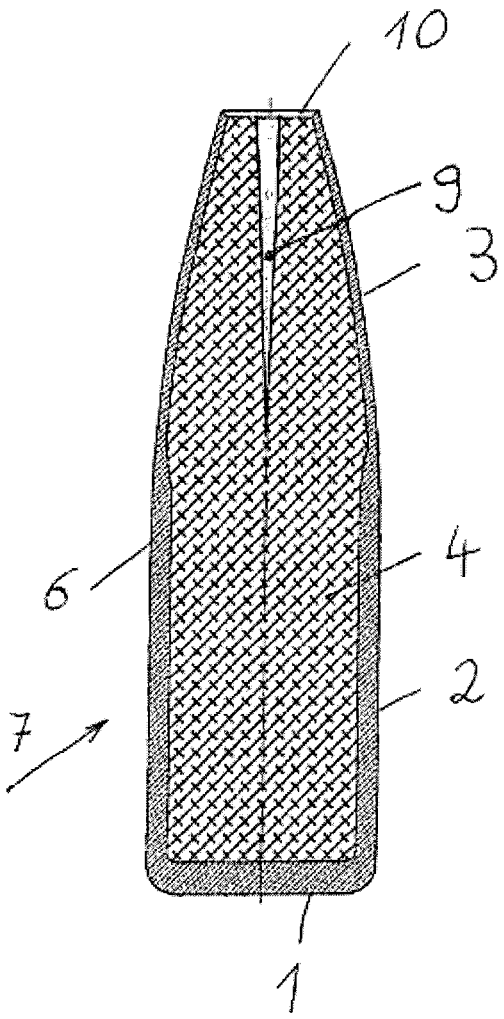

FIGS. 1 and 3 show a deformation projectile 7 according to the invention.

The deformation projectile 7 consists of a projectile jacket 6 and a projectile core 4. The projectile core 4 is soldered to the projectile jacket 6 and forms a fixed connection between projectile jacket 6 and projectile core 4 by way of soldering. The entire axial length of the projectile core 4 is soldered to the projectile jacket 6, i.e., the entire projectile core 4 is soldered to the projectile jacket 6. Internal or external intended breakpoints are introduced on the projectile jacket 6, which are not visible in FIGS. 1 and 3 however, since they are too small. These intended breakpoints preferably consist of axial scores, i.e., the projectile jacket 6 is scored in the axial direction.

Preferably between 2 and 20 intended breakpoints can be applied internally or externally in the projectile jacket 6, to initiate more rapid deformation when the deformation projectile 7 strikes the game carcass.

Different geometries of intended breakpoints 9 can be introduced into the soldered core 4 (see FIG. 3) in the axial direction to ensure a defined deformation. These intended breakpoints 9 are introduced using a stamp after the soldering, for example. The intended breakpoints 9 according to FIG. 3 have been pressed in using a stamp after the soldering.

When the deformation projectile 7 strikes the game carcass, the deformation begins. Due to the soldering of the projectile core 4 with the projectile jacket 6, projectile core 4 and projectile jacket 6 simultaneously deform up to twice or three times the projectile diameter with a stable projectile mass up to almost 100%.

Figure 2:
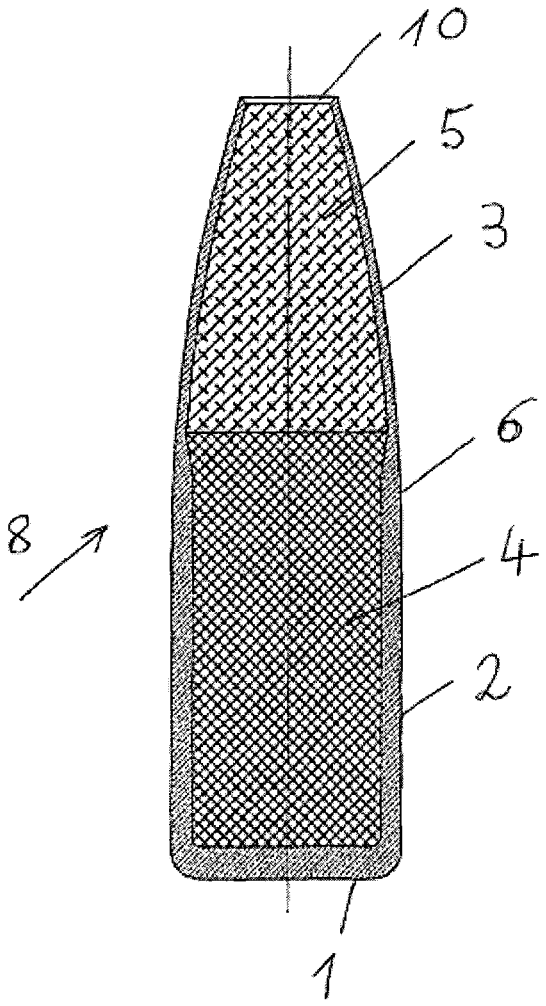

FIG. 2 shows a partially fragmenting projectile 8 according to the invention.

The partially fragmenting projectile 8 consists of a projectile jacket 6 and two cores 4, 5, wherein exclusively the rear projectile core 4 in the direction of the projectile base 1 is soldered to the projectile jacket 6. The rear region 2 means the cylindrical region of the partially fragmenting projectile 8. The front part 3 of the partially fragmenting projectile 8 form the ogive. A second projectile core 5, which is not soldered to the projectile jacket 6, but rather was only pressed in, is arranged in the front part 3 of the partially fragmenting projectile 8.

A fixed connection is thus only ensured between the rear projectile core 4 and the projectile jacket 6. The front second projectile core 5 in the ogive is only compressed with the projectile jacket 6 and not soldered. Internal or external intended breakpoints, preferably between 2 and 20, can be applied in the projectile jacket 6 (as also in the case of the deformation projectile according to FIGS. 1 and 3), to initiate more rapid partial fragmentation of the partially fragmenting projectile 8 when it strikes the game carcass. These intended breakpoints are preferably axially extending scores or notches.

Materials:

a) Deformation projectile

All materials which can be soldered can be used for the projectile jacket 6, preferably copper (Cu) and steel and its alloys. All lead-free materials which can be soldered and deformed well can be used as the projectile core 4, preferably tin and its alloys.

b) Partially fragmenting projectile

All materials which can be soldered can be used for the projectile jacket 6, preferably Cu and steel and its alloys. All lead-free materials which can be soldered and deformed well can be used as the projectile core 4, preferably tin and its alloys.

All lead-free materials which can be soldered and deformed well can be used for the fragmenting second projectile core 5, also granules or cores having incorporated intended breakpoints, preferably tin or its alloys. A compression force less than 6 tons is to be used during the production by compression.

The invention claimed is:

1. A projectile comprising a plurality of projectile cores and a projectile jacket forming a projectile base, an adjoining cylindrical rear region, and a front region, which is implemented as an ogive, a first of the plurality of projectile cores being soldered in the cylindrical rear region to the projectile jacket over its entire axial length, and a second of the plurality of projectile cores being a fragmenting core, being compressed with and not soldered to the projectile jacket, and being arranged in the front region, wherein intended breakpoints, which extend in the axial direction, are arranged on the projectile jackets starting from a front tip of the projectile jacket, whereby the projectile is a partially fragmenting projectile.

2. The projectile according to claim 1, characterized in that the intended breakpoints are arranged on an external surface of the projectile jacket.

3. The projectile according to claim 2, characterized in that the intended breakpoints are axially extending scores or notches.

4. The projectile according to claim 1, characterized in that the intended breakpoints have been introduced starting from the tip after the soldering.

5. The projectile according to claim 1, characterized in that the projectile jacket comprises copper or steel and its alloys.

6. The projectile according to claim 1, characterized in that the first of the plurality of projectile cores consists of a lead-free material which can be soldered and deformed.

7. The projectile according to claim 1, characterized in that the second of the plurality of projectile cores consists of a lead-free material which can be deformed and fragmented.

8. The projectile according to claim 7, characterized in that the second of the plurality of projectile cores comprises compressed granules or of materials having incorporated intended breakpoints.

9. The projectile according to claim 6, characterized in that the first of the plurality of projectile cores comprises tin and its alloys.

10. The projectile according to claim 7, characterized in that the second of the plurality of projectile cores comprises tin and its alloys.

11. The projectile according to claim 6, characterized in that the intended breakpoints are arranged on an external surface of the projectile jacket.

12. The projectile according to claim 11, characterized in that the intended breakpoints are axially extending scores or notches.

13. The projectile according to claim 6, characterized in that the intended breakpoints have been introduced starting from the tip after the soldering.

14. The projectile according to claim 6, characterized in that the projectile jacket comprises copper or steel and its alloys.

* * * * *